US005103202A

United States Patent [19]

Lennon et al.

[11] Patent Number: 5,103,202

[45] Date of Patent: Apr. 7, 1992

[54] AMBIENT COMPENSATED CIRCUIT BREAKER

[75] Inventors: John D. Lennon, South Windham; Douglas C. Carbone, Limington, both of Me.

[73] Assignee: GTE Products Corporation, Stamford, Conn.

[21] Appl. No.: 770,002

[22] Filed: Oct. 2, 1991

[51] Int. Cl.[5] ..... H01H 71/16; H01H 61/08; H01H 37/14

[52] U.S. Cl. ..... 337/100; 337/94; 337/103; 337/377

[58] Field of Search ..... 337/93-107, 337/112, 347, 360, 380, 377

[56] References Cited

U.S. PATENT DOCUMENTS

| | | | |
|---|---|---|---|
| 4,015,229 | 3/1977 | Senor et al. | 337/377 |
| 4,376,926 | 3/1983 | Senor | 337/104 |
| 4,636,766 | 1/1987 | Carbone et al. | 337/94 |
| 4,924,202 | 5/1990 | Schneider et al. | 337/100 |

*Primary Examiner*—Harold Broome
*Attorney, Agent, or Firm*—James Theodosopoulos

[57] ABSTRACT

An electrical circuit breaker comprises a metal base having a raised step to which an elongated compensator bimetal is welded. A metal cover is secured to the base but is insulated therefrom. An elongated armature bimetal is welded to a step in the metal cover and is substantially parallel to the compensator bimetal. The high expansion sides of both the compensator and the armature face downwards, towards the base. An insulated heater wire is wrapped around the armature and is electrically connected between the armature and the base.

5 Claims, 2 Drawing Sheets

AMBIENT COMPENSATED CIRCUIT BREAKER

BACKGROUND

This invention concerns circuit breakers containing two bimetals, one of which is a compensator. Examples of such circuit breakers are shown in U.S. Pat. Nos. 2,585,068, 4,521,760, 4,636,766 and 4,663,606. The invention is particularly concerned with a non-cycling circuit breaker. An example thereof is shown in U.S. Pat. No. 4,924,202.

SUMMARY OF THE INVENTION

An electrical circuit breaker in accordance with this invention comprises a metal base having a raised step. An elongated compensator bimetal is welded to the step, is substantially parallel to the base and has a contact at its end opposite the step. The compensator bimetal has a low expansion side and a high expansion side, the high expansion side being closer to the base than the low expansion side. There is a cover, also having a step, fastened to the base. An elongated armature bimetal is welded to this step, is substantially parallel to the compensator bimetal and has a contact at its end opposite the step, this contact being in contact with the compensator contact during normal operation. The armature bimetal has a high expansion side and a low expansion side, the high expansion side being closer to the compensator bimetal than the low expansion side. A heater wire is wrapped around the armature bimetal, one end of the heater wire being welded to the armature bimetal, the other end being in physical and electrical contact with the base. The cover is electrically insulated from the base.

PREFERRED EMBODIMENT

Figure 1:
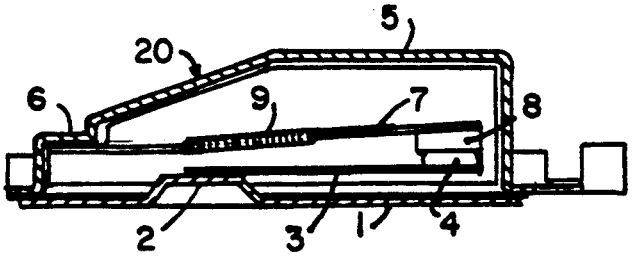
FIG. 1 is a sectional view of a circuit breaker in accordance with this invention.
Figure 2:
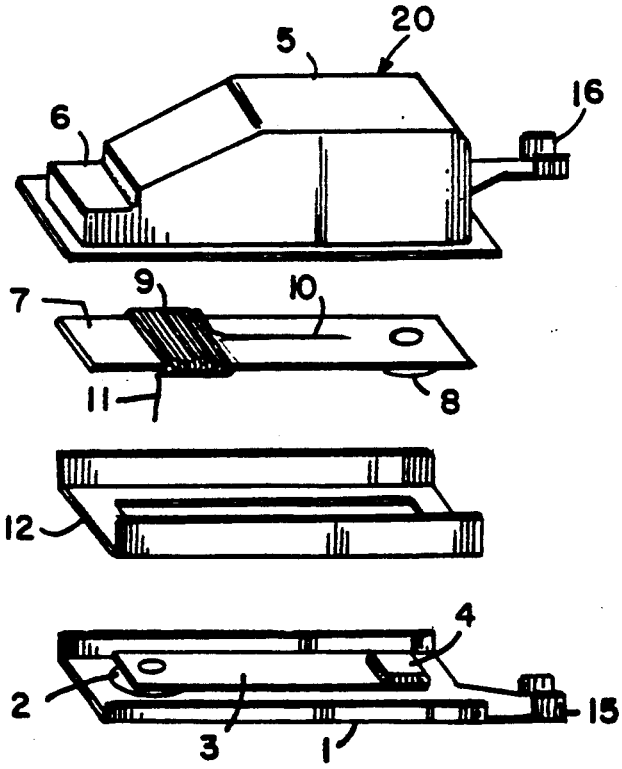
FIG. 2 is an exploded perspective view thereof and FIG. 3 is a perspective view.
Figure 3:
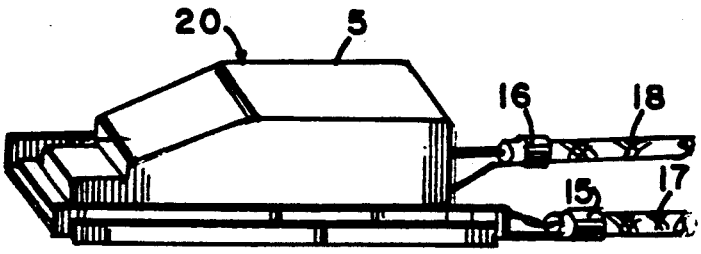
Figure 4:
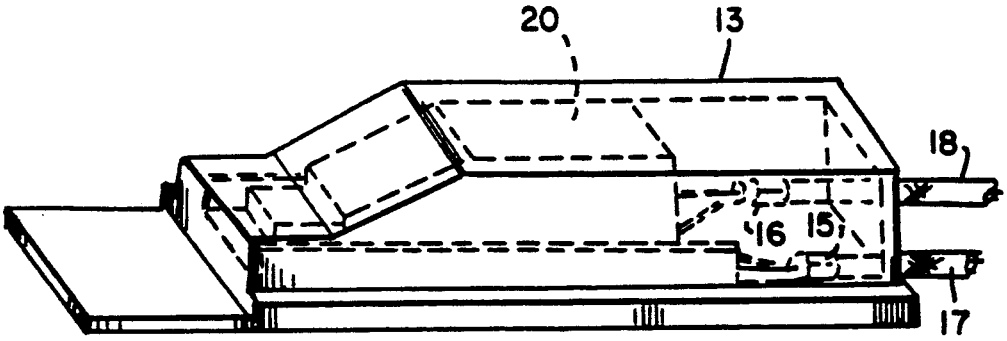
FIG. 4 is a perspective view, partly in phantom, showing the circuit breaker inside a plastic case
Figure 5:
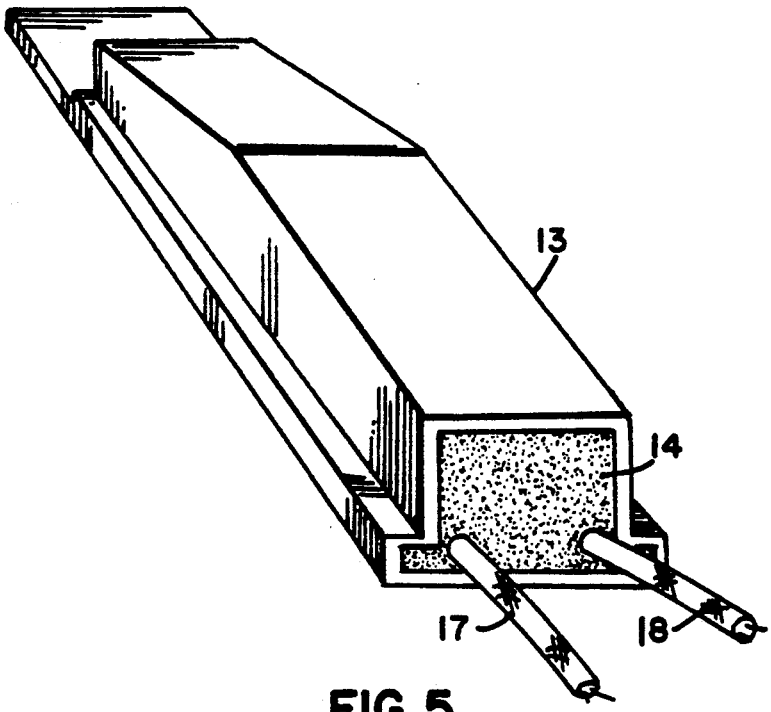
FIG. 5 shows the sealed end of the plastic case.

One example of a circuit breaker 20 in accordance with this invention comprises a metal base 1 having a raised step 2. An elongated compensator bimetal 3, substantially parallel to base 1, is welded to step 2(A). There is a contact 4 at the end of compensator 3 which is opposite to step 2. Fastened to base 1 is a cover 5 which has a step 6(B) at one end. An elongated armature bimetal 7, substantially parallel to compensator 3, is welded to step 6. Armature 7 has a contact 8 which is in contact with contact 4 during normal operation. There is an insulated heater wire 9 wrapped around armature 7. End 10, stripped of insulation, of heater wire 9 is welded to armature 7. End 11, stripped of insulation, of heater wire 9 extends outside of base 1 so that when cover 5 is secured to base 1 by, for example, crimping, end 11 is in physical and electrical contact with base 1. A sheet insulator 12 is disposed between base 1 and cover 5 to insulate them from each other. End 11 extends through opening 19 in insulator 12 to make contact with base 1.

An advantage to having steps in both cover 5 and base 1 is that either compensator 3 or armature 7 may be adjusted to correct opening time or temperature, if necessary, after cover 5 is secured to base 1.

The high expansion sides of both compensator 3 and armature 7 face base 1.

A purpose of this invention is to make the opening time and temperature of the circuit breaker substantially insensitive to ambient temperature. To meet this requirement we have found that a predetermined ratio between armature 7 and compensator 3 should be met. That is to say, the flexivity times the length squared divided by the thickness of armature 7 should be less than about 2½ times the flexivity times the length squared divided by the thickness of compensator 3. The ambient temperature variation is particularly stringent where the circuit breaker is to be installed under the hood of an automobile, such as the protector for the cooling fan.

In one example, flexivity F, length L and thickness T of armature 7 were 14.6, 1.2 inches and 21 mils, respectively. Flexivity F, length L and thickness T of compensator 1 were 14.0, 0.825 inches and 24 mils, respectively. F times $L^2$ divided by T for armature 7 equaled 1001 and, for compensator 3, equaled 397. The ratio for the armature to compensator was about 2½ to 1.

In this example, when the circuit breaker was tested at an overload of 44 amperes, the circuit breaker tripped in ten seconds at an ambient of minus 40° C., seven seconds at an ambient of 25° C. and four second at an ambient of 100° C., which results were satisfactory.

For use under the hood of an automobile, the circuit breaker should be sealed. Accordingly, circuit breaker 20 is inserted in a plastic case 13 having an open end which is then sealed with sealing material 14 such as, for example, an epoxy resin which hardens after it fills the open end.

For this purpose, it is desirable to form base 1 with a crimp type terminal 15 as an integral part thereof, that is to say, base 1 and terminal 15 are one piece of metal. Similarly, cover 5 has crimp type terminal 16 as an integral part thereof. Lead-in wires 17 and 18 are crimped to terminals 15 and 16, respectively, and extend out of sealing material 14 to provide for external electrical connection.

In operation, if circuit breaker 20 trips open, current will continue to flow through heater wire 9 which will maintain heat on armature 7 and prevent it from closing until the external power source is shut off.

We claim:

1. An electrical circuit breaker comprising: a metal base having a raised step A therein; an elongated compensator bimetal welded to said step A and being substantially parallel to said metal base; the elongated compensator bimetal having a low expansion side and a high expansion side, the high expansion side being closer to the metal base than the low expansion side; the elongated compensator bimetal having a contact A at its end opposite step A; a metal cover, having a step B, fastened to the base; an elongated armature bimetal welded to step B and being substantially parallel to the elongated compensator bimetal; the elongated armature bimetal having a contact B at its end opposite step B, contact B under normal operation being in contact with contact A; the elongated compensator bimetal having a high expansion side and a low expansion side, the high expansion side being closer to the elongated compensator bimetal than the low expansion side; a heater wire wrapped around the elongated armature bimetal, one end of the heater wire being welded to the elongated armature bimetal, the other end of the heater wire being in physical and electrical contact with the base; the cover being electrically insulated from the base.

2. The electrical circuit breaker of claim 1 wherein the elongated compensator bimetal has a predetermined flexivity $F_A$, a predetermined length $L_A$ and a predetermined thickness $T_A$ and wherein the elongated armature bimetal has a predetermined flexivity $F_B$, a predetermined length $L_B$ and a predetermined thickness $T_B$ and wherein the ratio of $F_A$ times $L_A$ squared divided by $T_A$ to $F_B$ times $L_B$ squared divided by $T_B$ is less than about 2.5 to 1.

3. The electrical circuit breaker of claim 1 wherein the base includes a crimp type terminal as an integral part thereof and wherein the cover includes a crimp type terminal as an integral part thereof.

4. An assembly consisting of:

(a) an electrical circuit breaker comprising a metal base having a raised step A therein; an elongated compensator bimetal welded to said step A and being substantially parallel to said metal base; the elongated compensator bimetal having a low expansion side and a high expansion side, the high expansion side being closer to the metal base than the low expansion side; the elongated compensator bimetal having a contact A at its end opposite step A; a metal cover, having a step B, fastened to the base; an elongated armature bimetal welded to step B and being substantially parallel to the elongated compensator bimetal; the elongated armature bimetal having a contact B at its end opposite step B, contact B under normal operation being in contact with contact A; the elongated compensator bimetal having a high expansion side and a low expansion side, the high expansion side being closer to the elongated compensator bimetal than the low expansion side; a heater wire wrapped around the elongated armature bimetal, one end of the heater wire being welded to the elongated armature bimetal, the other end of the heater wire being in physical and electrical contact with the base; the cover being electrically insulated from the base, and (b) said circuit breaker being contained within a plastic case having one open end, the open end being sealed with a sealing material.

5. An assembly consisting of:

(a) an electrical circuit breaker comprising a metal base having a raised step A therein; an elongated compensator bimetal welded to said step A and being substantially parallel to said metal base; the elongated compensator bimetal having a low expansion side and a high expansion side, the high expansion side bein closer to the metal base than the low expansion side; the elongated compensator bimetal having a contact A at its end opposite step A; a metal cover, having a step B, fastened to the base; an elongated armature bimetal welded to step B and being substantially parallel to the elongated compensator bimetal; the elongated armature bimetal having a contact B at its end opposite step B, contact B under normal operation being in contact with contact A; the elongated compensator bimetal having a high expansion side and a low expansion side, the high expansion side being closer to the elongated compensator bimetal than the low expansion side; a heater wire wrapped around the elongated armature bimetal, one end of the heater wire being welded to the elongated armature bimetal, the other end of the heater wire being in physical and electrical contact with the base; the cover being electrically insulated from the base, wherein the base includes a crimp type terminal as an integral part thereof and wherein the cover includes a crimp type terminal as an integral part thereof, and (b) said circuit breaker being contained within a plastic case having an open end, the open end being sealed with a sealing material, and lead-in wires crimped to the crimp type terminals of the base and the cover, the lead-in wires extending out through the sealing material.

* * * * *